US008727768B2

(12) United States Patent
Kemp

(10) Patent No.: US 8,727,768 B2
(45) Date of Patent: May 20, 2014

(54) ROTATING-GAS DISTRIBUTION DESIGN

(75) Inventor: Brendan Kemp, Sevenoaks (GB)

(73) Assignee: Limpsfield Combustion Engineering Co. Limited, Kent (GB)

( * ) Notice: Subject to any disclaimer, the term of this patent is extended or adjusted under 35 U.S.C. 154(b) by 843 days.

(21) Appl. No.: 12/808,262

(22) PCT Filed: Dec. 17, 2008

(86) PCT No.: PCT/GB2008/004160

§ 371 (c)(1),
(2), (4) Date: Mar. 28, 2011

(87) PCT Pub. No.: WO2009/077751

PCT Pub. Date: Jun. 25, 2009

(65) Prior Publication Data

US 2011/0306001 A1 Dec. 15, 2011

(30) Foreign Application Priority Data

Dec. 18, 2007 (GB) ..... 0724633.3

(51) Int. Cl.
*F23C 7/00* (2006.01)

(52) U.S. Cl.
USPC ..... 431/351; 431/350; 431/352; 431/353

(58) Field of Classification Search
USPC ..... 431/350, 351, 352, 353
See application file for complete search history.

(56) References Cited

U.S. PATENT DOCUMENTS

| | | | | |
|---|---|---|---|---|
| 2,177,245 | A * | 10/1939 | Dennis | 431/185 |
| 2,491,324 | A * | 12/1949 | Maki | 239/132.5 |
| 4,480,790 | A * | 11/1984 | Flanagan et al. | 239/214.25 |
| 4,604,052 | A * | 8/1986 | Brown et al. | 431/168 |
| 6,925,812 | B2 * | 8/2005 | Condevaux et al. | 60/776 |

FOREIGN PATENT DOCUMENTS

| | | |
|---|---|---|
| EP | 1462716 | 9/2004 |
| EP | 1808641 | 7/2007 |
| GB | 2345956 | 7/2000 |

OTHER PUBLICATIONS

International Searching Authority, "International Search Report", Jul. 20, 2009, Published in: WO.

* cited by examiner

*Primary Examiner* — Kenneth Rinehart
*Assistant Examiner* — Gajanan M Prabhu
(74) *Attorney, Agent, or Firm* — Fogg & Powers LLC

(57) ABSTRACT

A burner includes a generally cylindrical casing (1) and a burner head (2) mounted within the casing, the burner head including one or more vanes (9) rotatably mounted on the head and rotatable about the head to sweep through a region between the burner head (2) and the casing (1). The vanes (9) each include one or more gas outlets for introducing gas into an air flow through the region.

1 Claim, 4 Drawing Sheets

ROTATING-GAS DISTRIBUTION DESIGN

This application claims priority to International Patent Application No. PCT/GB2008/004160 filed on Dec. 17, 2008, which claims priority to Great Britain Patent Application No. 0724633.3 filed on Dec. 18, 2007.

This invention relates to a gas burner and to a method of operating a gas burner, and more particularly, but not exclusively, to an industrial gas burner which may, for example, generate a thermal output of the order of millions of BTU/hr (equivalent to hundreds of thousands or more probably millions of Watts).

Such a burner of a known kind comprises a generally cylindrical casing and a burner head mounted coaxially within the casing. In use air is blown past the burner head and gas, which has been fed to the burner head, is passed into the air flow passing the burner head. In order to burn the greatest possible amount of gas in the air flow, it is desirable to have the best possible mixing of the gas emitted from the burner head with the air flow past the burner head. Many proposals have been made in the past to promote, for example, through the use of diffusers, intimate mixing of the air flow and the gas. As is of course very well known intimate mixing is enhanced by turbulence and it is therefore common to generate a turbulent region to promote good mixing of the gas and the air.

It is an object of the invention to provide a gas burner, and a method of operating a gas burner, in which good mixing is achieved without resorting to the creation of considerable turbulence.

According to the invention there is provided a burner including a generally cylindrical casing and a burner head mounted within the casing, the burner head including one or more vanes rotatably mounted on the head and rotatable about the head to sweep through a region between the burner head and the casing, the one or more vanes each including one or more gas outlets for introducing gas into an air flow through the region.

By providing one or more rotatable vanes including gas outlets on the burner head it becomes possible to introduce gas into the air flow across substantially the whole of the air flow path and therefore a very good mixing of the gas and the air can be achieved solely by the way in which the gas is introduced.

It is a particular feature of the invention not to create undue turbulence through the introduction of the gas and it is accordingly preferable for the vanes to be shaped such that their effect on the air flow is able to be reduced as a result of their rotation. This can be achieved by shaping the vanes, arranging them at an angle of pitch to the airflow and then having them rotate in the direction that the airflow would cause them to rotate. Whilst it is within the broadest scope of the invention to have the vanes rotated solely by the air flowing past them, it is preferred that drive means, for example, an electric motor, are provided for drivingly rotating the vanes. Preferably the vanes are rotated at a speed related to their pitch and the speed of the airflow, such that in an axial direction the vanes provide little or no resistance to the axial airflow. Of course, if the vanes are of constant pitch and the speed of the airflow is approximately constant across the whole cross-section of the airflow then the best rotational speed for the vanes will be higher in a more central region of the airflow than in an outer region. It would if desired be possible and within the scope of the invention to allow for this variation by designing the vanes with a pitch that varied from their inner ends to their outer ends but it is at present believed that the extra benefit achieved by introducing such a variation in pitch would be small and it is therefore preferred not to do that.

Commonly it is desirable to operate a burner at a variety of firing rates and to control the gas and air flows through the burner according to the firing rates. Typically, an air blower is provided for creating a flow of air through the region swept by the one or more vanes. As the speed of the airflow through the burner is varied, so the speed at which the vanes are drivingly rotated is desirably varied. Thus the burner preferably further includes a speed control for controlling the speed of the drive means for drivingly rotating the vanes. The burner also preferably includes a regulator for controlling the speed of the air flow through the burner. Such a regulator may control the speed of an impeller generating the airflow and/or it may control a valve member partially obstructing the air flow path. The gas flow rate may be controlled by adjusting the pressure of gas at an inlet to the burner head. The burner preferably further includes a control system for controlling the speed of the drive means according to the speed of the airflow. Such a control system may be provided as a separate control arrangement or may form an integral part of a control system for the whole burner. The control system may make use of any of a variety of inputs to control the speed of the drive means according to the speed of the airflow. For example a device for measuring the speed of the airflow may be provided or, if the speed of the airflow is controlled in dependence upon the flow rate of gas, a signal indicating the flow rate of the gas may provide the input to the control system, or the speed of the drive means may be adjusted according to the pressure difference in the airflow between a location upstream of the vanes and a location downstream of the vanes. That last approach is adopted in an embodiment of the invention, described below where the speed of the drive means is adjusted until there is no pressure difference between a location immediately upstream of the vanes and a location immediately downstream of the vanes.

The one or more vanes may take any of a wide variety of forms not necessarily having any aerodynamic shaping. Preferably a multiplicity of vanes are provided equiangularly spaced apart around the burner head. For example, if nine vanes were provided, they would be spaced apart at intervals of 40 degrees. It may be preferable to provide more than nine vanes. For example there may be between 15 and 30 vanes and in an embodiment of the invention described below there are twenty vanes spaced at intervals of 18 degrees. The vanes preferably sweep through substantially the whole of the cross-section through which the air flows.

Each of the one or more vanes preferably includes a multiplicity of air outlets. For example, each vane may comprise a hollow member formed with more than 10, and preferably more than 20, outlets. In an embodiment of the invention described below, there are 38 outlets on each vane.

The angle of pitch of the vanes may be chosen according to any particular application and what proves most desirable. Preferably the angle of pitch is in the range of 35 to 75 degrees. For example, the pitch angle could be about 45 degrees but it may also be reduced or increased from that value; for example, it could be increased to about 67 degrees. Of course, as already mentioned above, the angle of pitch may vary along the length of each vane. For a given burner and a given set of operating conditions the speed at which the vanes are preferably rotated is of course reduced as the pitch of the vanes is increased.

Preferably each of the one or more vanes is formed from a tubular member, which preferably extends substantially radially from the burner head. Preferably the outer end of the tubular member is closed and the inner end, mounted in the burner head, is open allowing gas to pass from the burner head into the tubular member. To facilitate attachment to the burner head, the inner end of the tubular member is preferably of circular cross-section, but to facilitate the formation of a vane the rest of the tubular member is preferably of an oval cross-section. The oval cross-section may readily be formed by deforming the tubular member from an original circular cross-section. The deformation may be such that the longest dimension from one side to the other of the oval cross-section is of the order of at least twice the shortest dimension.

The outlets are preferably formed at least mainly in the downstream sides of the vanes. Preferably more outlets are provided in the region of the outer ends of each vane than towards the inner end, to generate an even distribution of gas into the air flow. Of course, it is also possible to vary the sizes of the outlets, with bigger outlets in the region of the outer end and smaller outlets in the region of the inner end.

The present invention also provides a method of operating a burner as defined above, in which air flows through the region between the burner head and the casing and the one or more vanes rotate about the head, sweeping through the region between the burner head and the casing, and gas flows out through the one or more outlets in the one or more vanes.

By way of example, a burner embodying the invention will now be described with reference to the accompanying drawings, of which:

Figure 1:
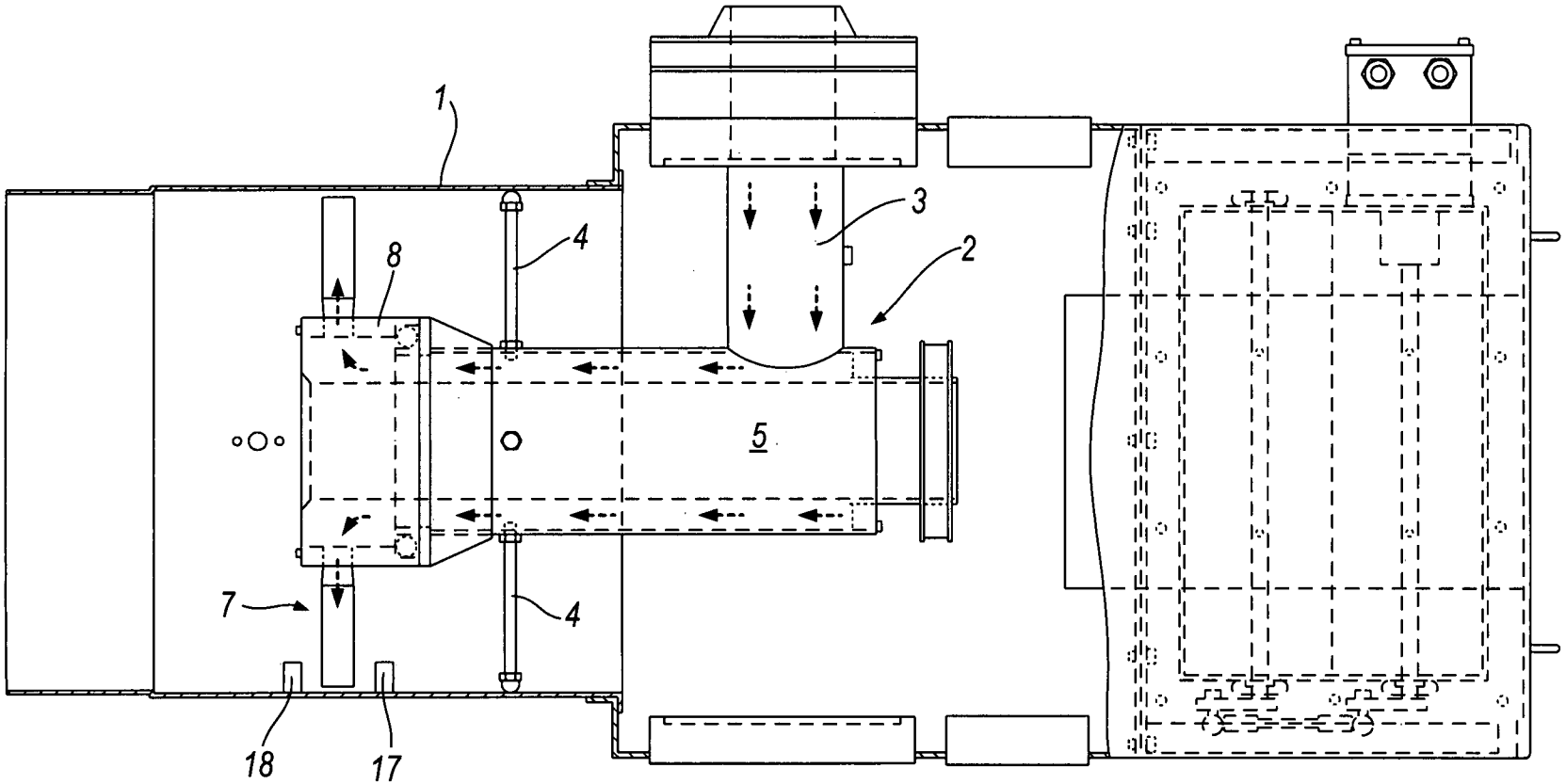
FIG. 1 is a sectional side view of the burner which includes a burner head mounted therein.
Figure 2:
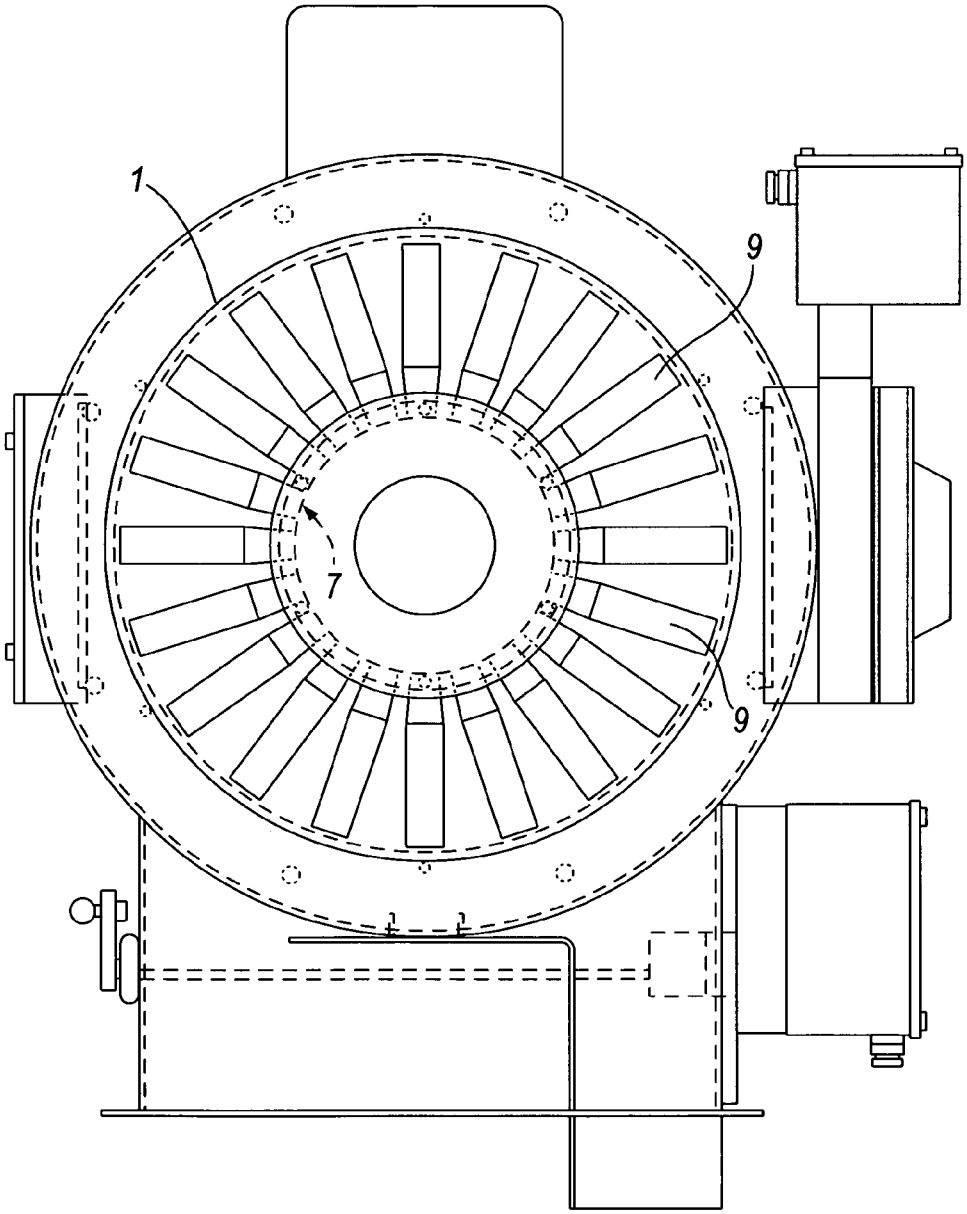
FIG. 2 is a front view of the burner.
Figure 3:
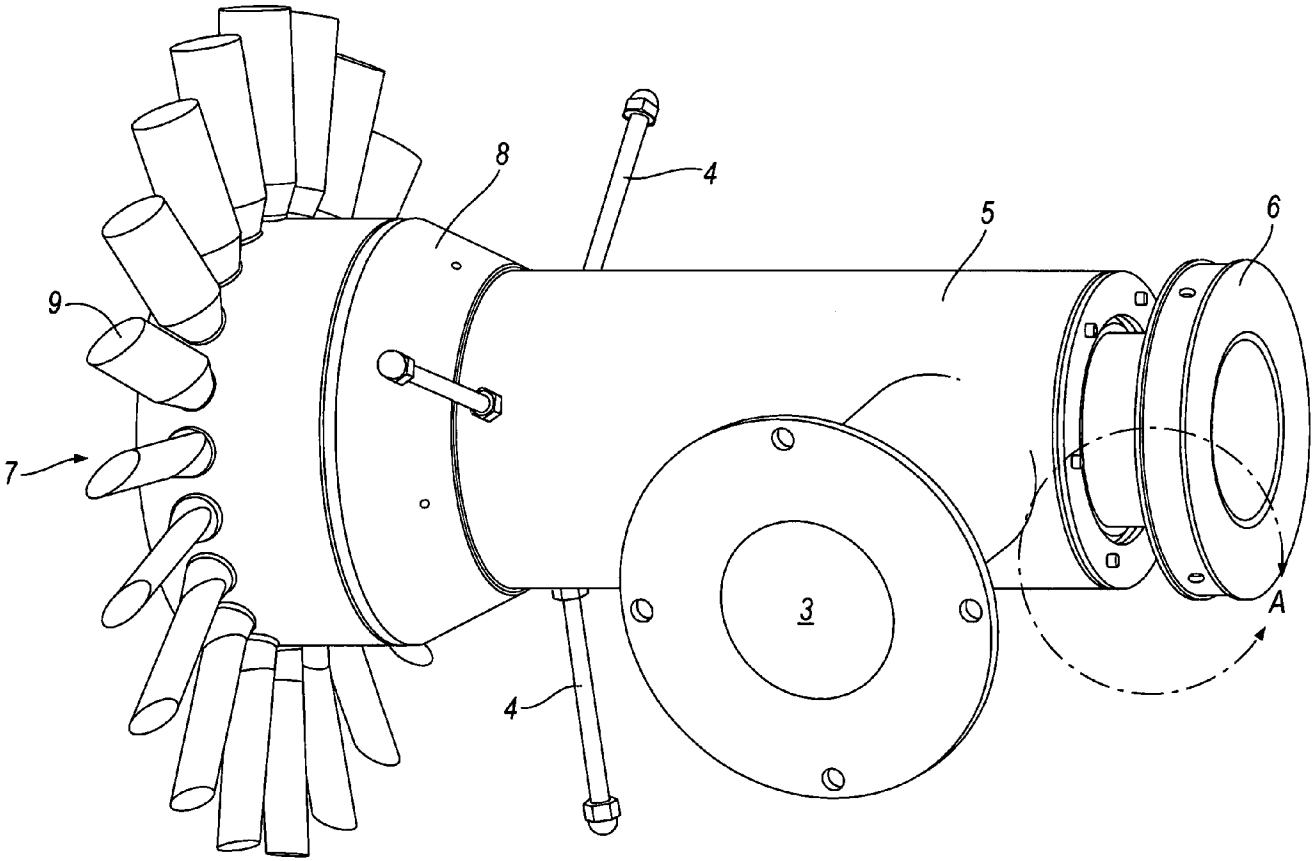
FIG. 3 is a perspective view of the burner head.

Referring first to FIGS. 1 to 3, there is shown a burner including a casing 1 in a cylindrical part of which a burner head 2 is mounted. The burner head 2 has a central portion coaxial with the cylindrical part of the casing 1 and is supported in the casing 1 at a rear end by a gas manifold 3 and at a front end by three rods 4 that extend radially outwardly from the burner head 2 to the casing 1.

In operation of the burner, air is driven through the casing 1 from the right to the left, as seen in FIG. 1, by an impeller (not shown). Gas to be burnt is passed into the gas manifold 3, and passes along the burner head from right to left before being introduced into the airflow that is passing through the casing 1 and around the burner head 2 at the downstream (left as seen in FIG. 1) end of the burner head.

The features of the burner head described above are known per se. The burner head 2 embodying the invention also includes certain special features: a shaft 5 is rotatably mounted along the central axis of the burner head 2 and carries a drive pulley 6 at its upstream end and a vane assembly 7 at its downstream end. The vane assembly 7 includes an annular chamber 8 from which vanes formed by tubes 9 extend radially outwardly terminating just inside and clear of the casing 1.

Figure 4:
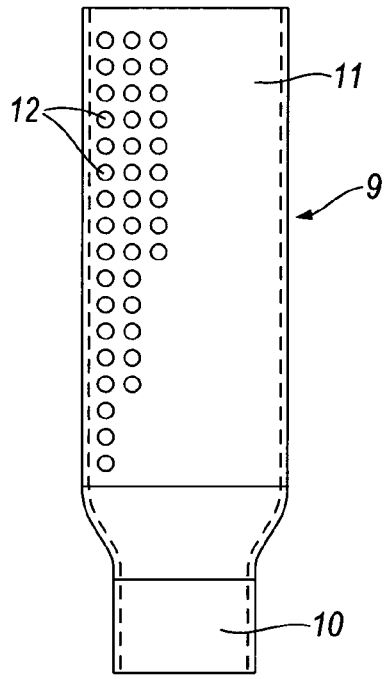
FIG. 4 is a side view of a gas outlet vane forming part of the burner head.
Figure 5:
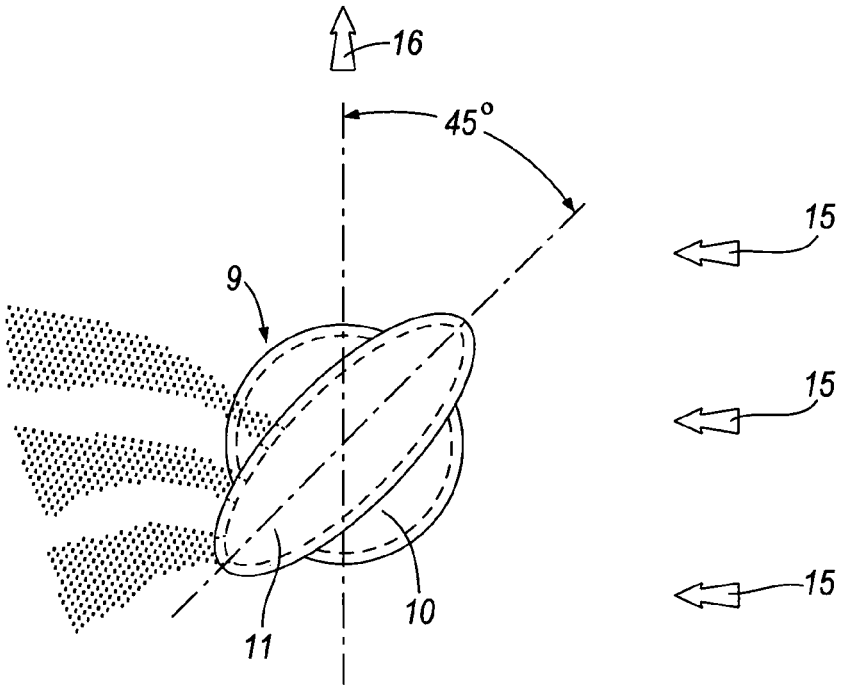
FIG. 5 is an end view of the gas outlet vane.

FIGS. 4 and 5 show one of the tubes 9 of the vane assembly 7. The tube has an inner portion 10 of circular cross-section and an outer portion 11 of oval cross-section. The outer portion 11 can conveniently be formed by deformation of the tube from a circular cross-section. The outer portion 11 is closed by a cap (not shown) at its distal end and is provided with a series of holes 12 defining gas outlets extending along the length of the tube, with more holes 12 being provided toward the outer end of the tube than toward the inner end.

In the example of the invention shown in FIGS. 4 and 5 the longest dimension of the oval cross-section of each tube 9 is inclined at an angle of about 45 degrees to the direction of air flow through the casing 1, that direction being shown by arrows 15 in FIG. 5. As can also be seen from FIG. 5, the holes 12 are in the trailing region of the outer portion 11 of the tube 9 and the tube 9 is drivingly rotated in the direction of arrow 16. In an alternative arrangement, in which the tube is set at a greater angle of pitch and is rotated more slowly, the longest dimension of each tube is inclined at an angle of about 67.5 degrees to the direction of arrow 16.

In operation the shaft 5 is drivingly rotated by an electric motor (not shown) driving the pulley 6 via a belt (not shown) and the tubes 9 are thereby driven around the burner head 2, sweeping through the annular space between the chamber 8 and the casing 1. The direction of rotation of the tubes 9 and the direction in which the oval cross-sections of the tubes 9 are inclined to the airflow are those that would generate a flow of air in the direction in which it is actually flowing. Furthermore the tubes 9 are rotated at a speed related to the speed of the air flow so that, viewed along a line parallel to the axis of rotation of the tubes 9, the point of intersection of the line with the leading face of a tube moves along the line at about the same velocity as the airflow. Consequently the resistance to the air flow is very much reduced and the turbulence also reduced. At the same time because the gas is introduced into the air flow along the lengths of all the tubes which are themselves rotating, the gas is well distributed throughout the airflow even from the moment that it leaves the tubes.

As the firing rate of the burner is adjusted, so the gas and air flow rates are adjusted so that the speed of the air through the annular space between the chamber 8 and the casing 1 is altered. It is therefore desirable that the speed of rotation of the tubes 9 is also adjusted in proportion to the change in the speed of the air flow and for that purpose the speed of the electric motor driving the pulley 6 is controlled, for example via an inverter drive, according to the speed of the air flow. It is not unusual for a burner to operate over a ten to one range of fuel flow rates. As shown schematically in FIG. 1, pressure sensors 17 and 18 may be provided immediately upstream and downstream of the vanes. A control unit receiving signals from the pressure sensors 17 and 18 is then able to adjust the speed of the drive from the pulley 6 until the pressures measured at the sensors 17 and 18 are the same, indicating that the tubes 9 are neither braking nor accelerating the air flow.

As will be understood from the description above, there are many ways in which the design of the burner described above may be varied without departing from the invention. For example, the vanes may take a wide variety of shapes and sizes with openings in various locations. The number and pitch of the vanes may be varied and the dimensions of the burner head and casing varied.

In one particular example of the invention, in which Natural Gas is the fuel, there are 20 tubes 9, each with 38 outlets formed by 1.2 mm diameter holes. The pressure of the gas in the manifold 3 is maintained at 3 psi (approximately 20684 Pa) leading to a firing rate at complete combustion of 21 million BTU/hr (approximately 6.3 million Watts). With that combustion rate an air flow of 224,000 cubic foot per hour (approximately $1{,}724{,}800\times10^{-6}$ $m^3/s$) is required resulting in an air flow speed through the annular space between the chamber 8 and the casing 1 of about 85 ft per second (approximately 26 m/s). With the tubes 9 angled at 45 degrees to the airflow, the tubes are rotated at about 1660 r.p.m. in order to match the air flow speed.

In another case, the example above is modified in that: each tube is provided with 20 holes each of 1.5 mm diameter arranged in a single line but with the spacing of the holes decreasing towards the outer end of each tube.

Whilst reference is made in the specification to mixing the fuel (gas) with "air" and in most applications it will be convenient simply to use ambient air, it is of course within the scope of the invention to modify the "air" prior to combustion. Also whilst the burner is necessarily capable of burning gas as a fuel and the invention is concerned with the way in which the gas is introduced into an air flow it is also possible for the burner to have a facility for burning oil.

The invention claimed is:

1. A method of operating a burner, in which air flows through a region between a burner head and a casing and one or more vanes rotate about the head, sweeping through the region between the burner head and the easing, and gas flows out through one or more outlets in the one or more vanes, wherein the one or more vanes are drivingly rotated by a drive means that comprises an electric motor, and the speed of the drive means is controlled by a speed control, in which the one or more vanes are drivingly rotated at a speed that is varied as the speed of the air flow between the burner head and the casing varies.

* * * * *